US005119615A

United States Patent [19]

Kujubu et al.

[11] Patent Number: 5,119,615

[45] Date of Patent: Jun. 9, 1992

[54] APPARATUS FOR FILLING A PRODUCT INTO A BAG

[75] Inventors: Eitaro Kujubu; Tadamichi Takeda; Tatsuo Higami, all of Mihara; Hiroshi Yoshimoto, Hiroshima, all of Japan

[73] Assignee: Furukawa Mfg. Co., Ltd., Tokyo, Japan

[21] Appl. No.: 719,473

[22] Filed: Jul. 11, 1991

[51] Int. Cl.[5] ..... B65B 57/04

[52] U.S. Cl. ..... 53/53; 53/73; 53/74; 53/573

[58] Field of Search ..... 53/53, 55, 58, 57, 74, 53/73, 76, 52, 284.7, 250, 249, 573, 571

[56] References Cited

U.S. PATENT DOCUMENTS 3,359,702 12/1967 Beert et al. ..... 53/53
3,606,014 9/1971 Linn ..... 53/53 X
3,982,376 9/1976 Ikeda ..... 53/53
4,510,730 4/1985 Edmondson ..... 53/53
4,534,158 8/1985 McClosky ..... 53/570 X
4,928,473 5/1990 Nagao et al. ..... 53/53

*Primary Examiner*—James F. Coan
*Attorney, Agent, or Firm*—Joseph W. Farley

[57] ABSTRACT

A plurality of clamps arranged in equally spaced relation on an endless track are intermittently advanced at a pitch equal to the distance of each two adjacent clamps. A switch reactive only to the passage of a sufficiently heavy or filled bag which has been filled with an article is disposed downstream of a filling station, one of the stop positions for clamps. When the passage of a bag is not responded by switch, that is, when an empty or unfilled bag has passed near the switch, the particular clamp by which the empty bag is held is caused to pass through the final stop position and, in turn, through the first stop position before it can again reach the filling station, with the empty bag being held by the clamp all the while.

7 Claims, 6 Drawing Sheets

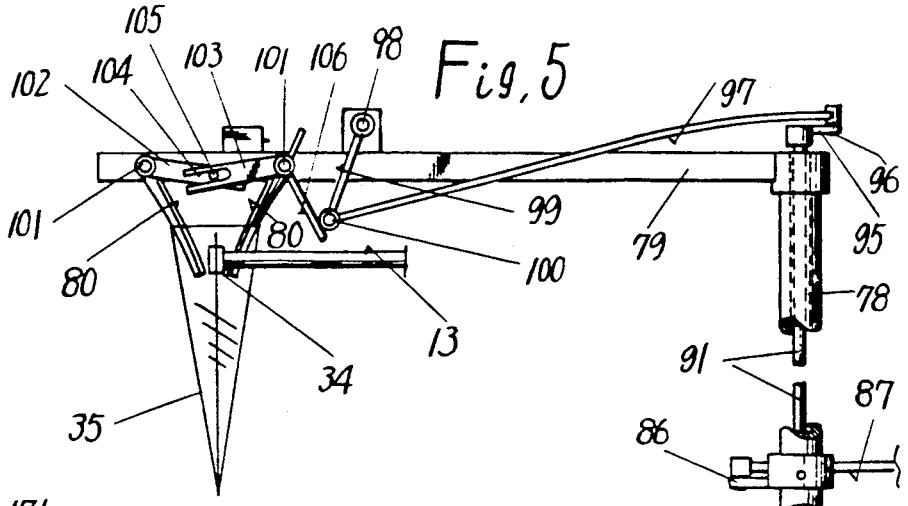
Fig. 5
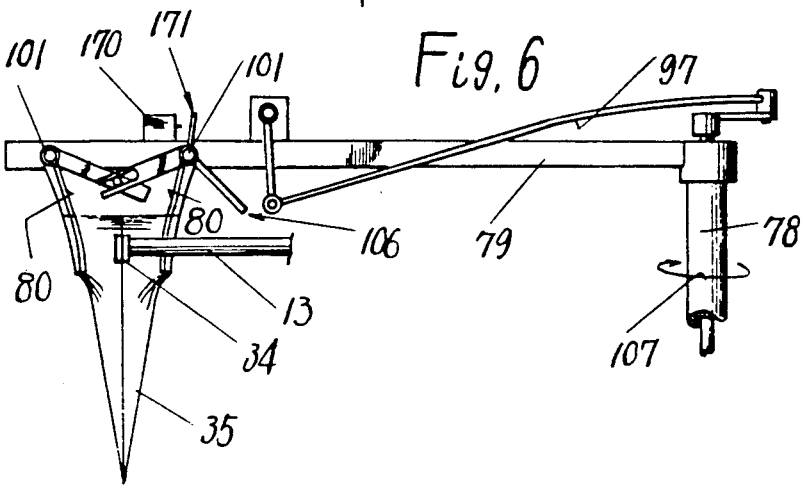
Fig. 6
Fig. 7
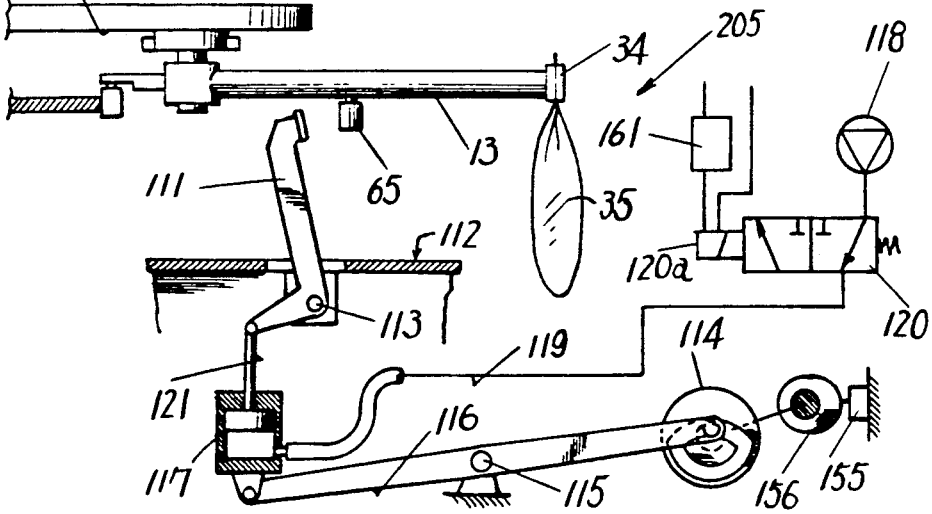

APPARATUS FOR FILLING A PRODUCT INTO A BAG

FIELD OF THE INVENTION

The present invention relates to a bag filling apparatus of the rotary type wherein a large number of sets of clamps are circulated along an endless path at equal intervals and, at a predetermined position on the endless path, packaging bags are sequentially supplied to successive clamps moving in circulation along the endless path, whereafter the bags conveyed while being suspended from the successive clamps are filled with a product, the bags being then released from the clamps at a point prior to the bag supply position.

BACKGROUND OF THE INVENTION

One example of prior-art rotary type bag filling apparatus is described in U.S. Pat. No. 3,982,376, wherein a multiplicity of clamps arranged equidistantly on an endless chain are moved in circulation integrally with the chain along an elliptic path so that while the clamps are advanced at one-pitch intervals on the elliptic path, bags are sequentially supplied to the clamps, are opened wide at the mouth while being suspended from the respective clamps, and are then filled with a product; thereafter heat is applied to seal the mouth of each filled bag, and at a terminal station of the process, the bags are successively released from the clamps. Another arrangement is disclosed in U.S. Pat. No. 4,534,158, wherein a large number of clamps are arranged around the peripheral edge of a disc in equally spaced relation and adapted to be advanced integrally with the disc at one-pitch intervals, so that a similar type of operation is carried out during one cycle of movement of the clamps around the circular path. Known bag filling apparatuses of the above described type have a common advantage that they are very efficient in that packaged products are mechanically turned out at exactly same intervals as the feed pitch of the clamps.

With these prior art apparatuses, however, one problem is that, as often encountered with automatic product filling machines, when the product storage tank has become empty, the emptiness remains unnoticed for some time so that empty bags suspended from the clamps successively pass beneath the filling hopper without being filled. In manual mode filling operation in which product filling is manually carried out, it may sometimes happen that some bags are inadvertently skipped and passed without being filled. In the prior art arrangement, no preventive measure is taken against such filling failure, and therefore, empty bags, if any, remaining as such will be sealed at the mouth in same way as filled bags. The sealed empty bags cannot be recycled. This is very uneconomical. At the operating location where filled bags are released from the clamps, empty or unfilled bags, if any, may fly in the air when released from the clamps.

SUMMARY OF THE INVENTION

The present invention is directed to solving these problems, and accordingly it is a primary object of the invention to provide a packaging apparatus wherein bags in circulation with clamps are electrically sensed as to their condition, filled or unfilled, so that any bags found as having erroneously been left unfilled are recycled accordingly.

In order to accomplish the above object, according to the present invention there is provided a packaging apparatus including a multiplicity of clamps biased constantly in closed condition by force generating means and arranged in angularly equispaced relation on an endless track, the clamps being adapted to be intermittently advanced along the endless track at a pitch equal to the distance between each two adjacent clamps, by supply means located at a first stop position at which the clamps are initially caused to stop in the course of their movement on the endless track, for supplying bags to temporarily opened clamps, it being so arranged that the clamps are caused to stop at a second stop position to enable an article to be filled into each of the bags suspended from the clamps and are again caused to stop at a final stop position at which the bags are released from the clamps, comprising: a shift register for generating shift timing signals of same timing as intermittent movement of the clamps on the endless track and for detecting said final stop position and said first stop position on the endless track, an input switch for electrically detecting the condition of filling effected with respect to each of the bags suspended from the clamps and for inputting to said shift register a detection signal with respect to said condition, and means responsive to command signals from said shift register when any unfilled bag detected by said switch has reached said final position on the endless track and, in turn, when the unfilled bag has reached said first stop position, for maintaining the action of said force generating means on the clamps at the two positions thereby to cause the clamps to be kept in their closed condition.

When the clamps, in their intermittent movement on the endless track, stop beneath an automatic filling machine, an article is automatically supplied by the automatic filling machine for being filled into bags suspended from individual clamps. A switch provided in the filling machine is able to sense the flowing down of the article to determine that a particular bag has been sufficiently filled. Where filling operation is performed manually, the switch held in contact with the bag will sense the volume of the article filled in the bag to determine that the bag has been filled. Each signal sent from the switch is inputted to a shift timer. When a signal indicative of an empty bag is inputted to the shift timer, the movement of the empty bag is calculated by the shift timer and, when the empty bag reaches the final stop position, the clamping force of the clamp supporting the empty bag is maintained as it is, to prevent the empty bag being unclamped. At same time, bag transfer action of the bag delivery device for transfer of the bag from the clamp to the vacuum chamer is suspended. Further, at the next stop position, bag supply to the clamp is suspended, and the clamp is held in its bag holding position. As a result, the possibility of empty bag delivery to the chamber for meaningless sealing is eliminated, and the empty bag can be recycled.

BRIEF DESCRIPTION OF THE DRAWINGS

FIG. 5 is a fragmentary side view showing a bag release station seen in FIG. 1;

FIG. 6 is an explanatory view showing a functional aspect of FIG. 5;

FIG. 7 is a fragmentary side view showing a bag transfer station seen in FIG. 1;

DESCRIPTION OF THE PREFERRED EMBODIMENTS

Figure 1:
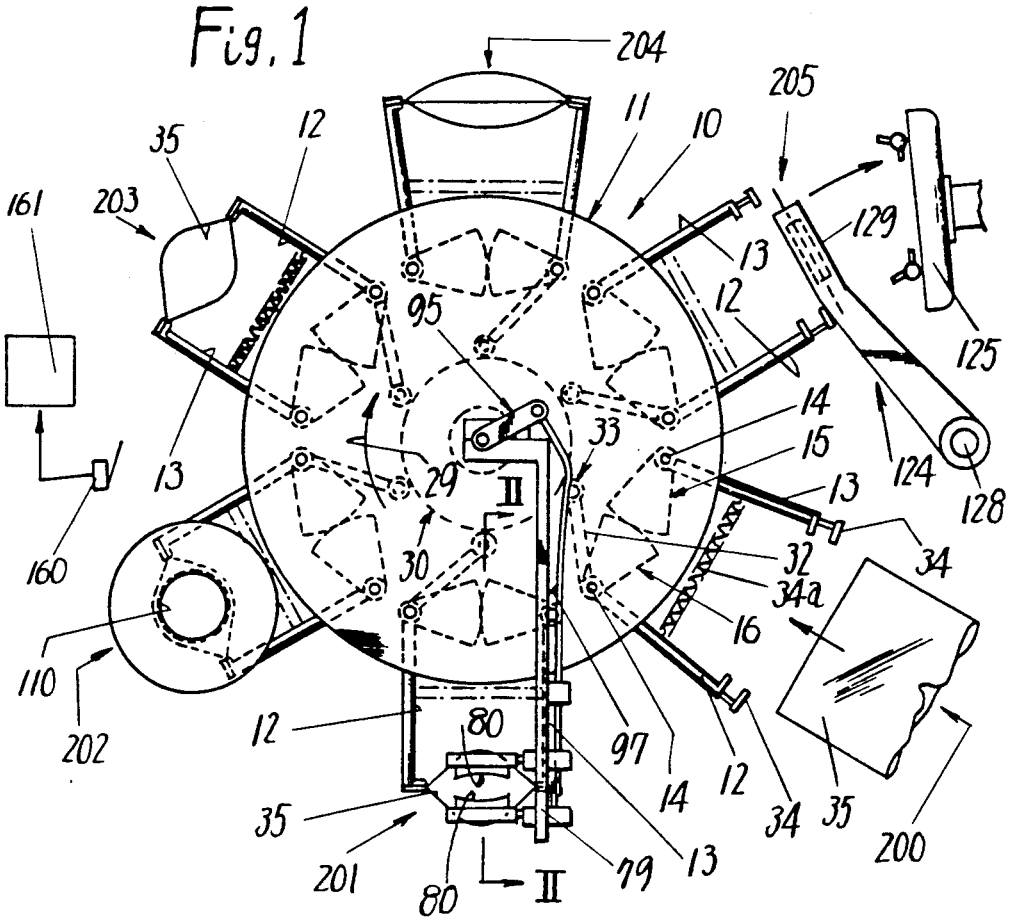
FIG. 1 is a plan view showing one embodiment of the present invention.
Figure 2:
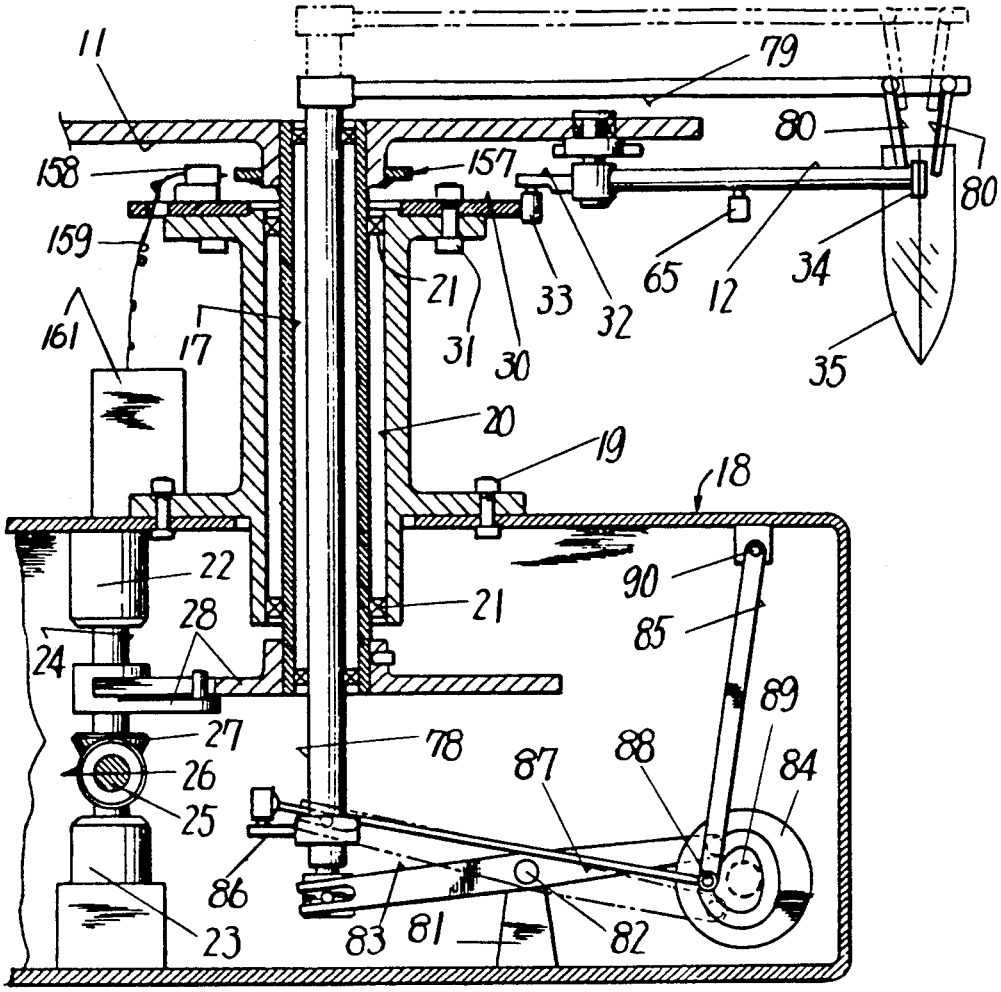
FIG. 2 is a section taken along line II—II in FIG. 1 in the direction of the arrow.

In FIG. 1, a bag filling apparatus designated by 10 comprises a large circular table 11, six pairs of arms 12, 13, right and left, laterally pivotally supported on the table 11 through respective pins 14, sectoral gears 15, 16 fixed to the respective arms 12, 13 and held in mesh with each other, each pair of the arms 12, 13 being connected to each other so that the one arm 13 is movable in response to the movement of the other arm 12. As FIG. 2 shows, a cylindrical main shaft 17 extends downward from a center portion of the table 11 and is supported via a ball bearing 21 in a housing 20 fixed by a bolt and nut set 19 to a machine frame 18. A drive shaft 25 is articulated through bevel gears 26, 27 to a driven shaft 24 supported at both ends in bearings 22, 23 within the machine frame; and the driven shaft 24 and the main shaft 25 are interconnected through a Geneva stop 28. Thus, the driven shaft 24 is driven by a transmission from the drive shaft 25 and, under the indexing action of the Geneva stop 28, the table 11 is intermittently rotated for an angular distance of 60° each. Therefore, the table 11 in FIG. 1 is rotatable clockwise 29 for an angular distance defined between the six sets of arms 12 to shift the respective arms.

As FIG. 2 shows, a plate cam 30 is fixed to the top of the housing 20 through a bolt and nut set 31, and a roller 33 disposed adjacent the end of a lever 32 at one end of the one arm 12 is held in contact with the periphery of the plate cam 30. Further, as shown in FIG. 1, the roller 33 is even held in abutment against the periphery of the plate cam 30 under the tensile force of a spring 34*a* provided between each two arms 12, 13. Accordingly, when each arm is rotated about the periphery of the plate cam 30 in integral relation with the table 11, the distance between each pair of arms 12, 13 at their distal ends is widened or narrowed according to the pattern of deformation of the periphery of the plate cam 30. When the arms 12, 13 have stopped at the first stop position 200 on the orbital path, bags 35 are supplied to clamps 34, 34 at distal ends of the arms 34, 34 in the following fashion.

Figure 3:
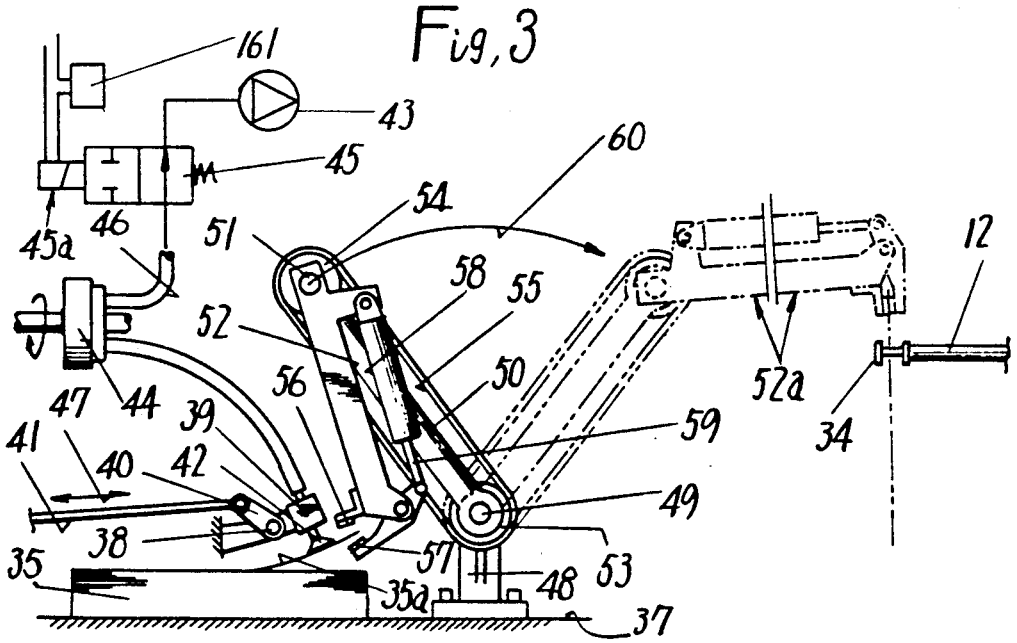
FIG. 3 is a fragmentary side view showing a bag supply station seen in FIG. 1.

As shown in FIG. 3, at the first stop position or a bag supply station 200 there is provided a table 37 for flatly stacking a large number of bags 35, with a block 39 rotatably supported about a pin 38 fixed at a level above the table, a lever 40 coupled to the block being connected with a transmission cam (not shown) for the lever 40 through a linkage 41. A vacuum cup 42 is disposed on the underside of the block 39 and is connected to a vacuum pump 43 through a line 46 on which are disposed a rotary valve 44 and an on-off valve 45. The linkage 41 is movable back and forth as shown by arrow 47 each time the arms 12, 13 mounted to the table are brought to a stop. Through this reciprocal movement of the linkage 41 the block 39 is inverted about the pin 38 to lift an open edge of the uppermost bag 35*a* of the stacked bags through the vacuum cup 42 to which the uppermost bag 35*a* is sucked. An inverting shaft 49 is rotatably supported in a bearing 48 disposed on the table 37, with an arm-type frame 50 fixed to the inverting shaft 49, a pin 51 being rotatably fitted to the distal end of the frame, to which pin 51 is fixed one end of a lever 51. An endless belt 55 is trained between a first pulley 53 fixed to the bearing 48 and a second pulley 54 fixed to one end of the pin 51, and a stationary collar 56 and a movable collar 57 are disposed at the distal end of the lever 52, with a piston rod 59 of an air cylinder 57 connected to the movable collar 57. When the frame 50 is pivoted by the inverting shaft 49 in the direction of arrow 60, the first pulley 53 stationarily fixed to the shaft 48 allow the belt 55 to be held taut and accordingly the second pulley 54 is rotated counterclockwise to rotate the lever 52 through the pin 51 to a position shown in phantom 52*a*. In this case, the air cylinder 58 is actuated to move the movable collar 57 so that bag 35*a* is initially held between the two collars 56, 57, and thus bag 35*a* is supplied toward the clamp 34 at the distal end of the arm through the rotation of the lever 52. It is noted that the rotary valve 44 opens and closes the line 46 at predetermined time intervals to control the sucking action of the vacuum cup 42.

Figure 4:
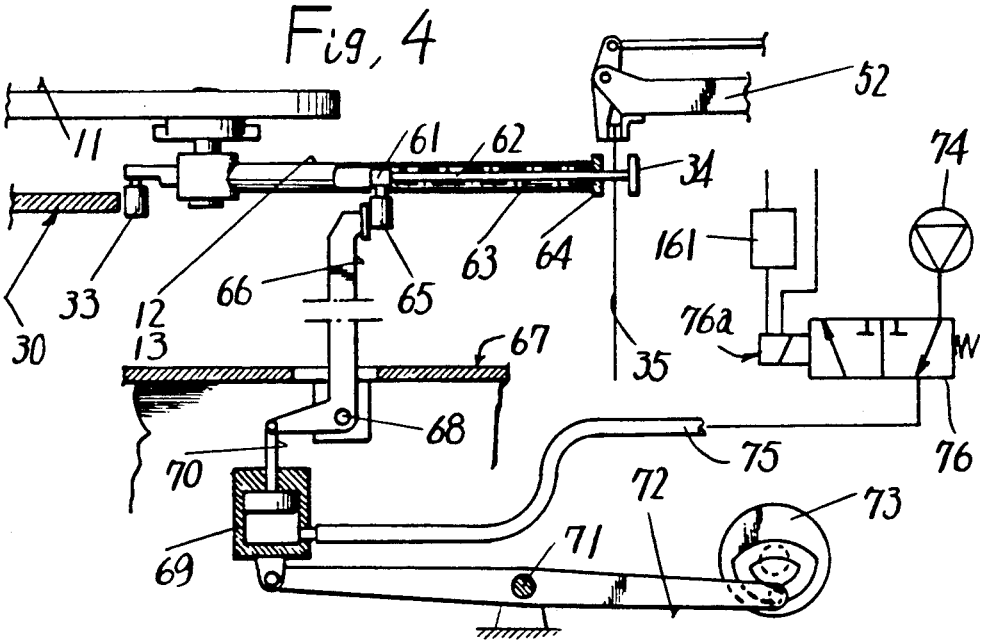
FIG. 4 is a fragmentary side view showing other aspect of the bag supply station seen in FIG. 1.

As FIG. 4 shows, each arm 12, 13 is hollow in which a slider 61 is slidably disposed, which slider 61 is connected through a rod 62 to a clamp 34 disposed at the distal end of the arm 12, 13. Further, within the interior of the arm 12 is provided a tension spring 63 so that the clamp 34 is pressed against the distal end face 64 of the arm 12 under the tensile force of the tension spring 63, whereby bag 35 is held in position. The clamp 34 can be separated from the distal end face 64 of the arm by applying a pressing force of an attachment 66 to a pin roller 65 projecting from the bottom of the slider 61. The attachment 66 is comprised of an L-shaped material pivotally supported on a machine frame 67 through a pin 68, the lower end of the attachment 66 being connected to a piston rod 70 of an air cylinder 69. The air cylinder 69 is connected to one end of a lever 72 pivotable about a pin 71, and the other end of the lever 72 is held in engagement with a groove cam 73. The interior space of the air cylinder 69 is connected to a pressure pump 74 via line 75, with an open-type three-way valve 76 interposed on the line 75. The piston rod 70 of the air cylinder 69 is constantly held in stretched condition under the force of pressurized air from the pressure pump 74, and the air cylinder 69 is maintained in its rigid state. Thus, through the rotation of the cam 73 the lever 72 operates to pivot the attachment 66 of the lever 72 at a predetermined cyclic interval so that each bag 35 supplied through the lever 52 is firmly clamped in position.

In FIG. 1, while two clamp arms 12, 13 are moved from the bag supply station 200 to next bag opening station 201, the distance between the two clamp arms 12, 13 is reduced through sinking of the periphery of the plate cam 30, and accordingly the mouth of bag 35 is opened. As FIG. 2 shows, a core rod 78 is vertically slidably provided in the interior of the main shaft 17, and a horizontal bar 79 is horizontally fixed to the top end of the core rod 78, with two flexible spatula plates 80, 80 disposed at the front end of the horizontal bar. A seesaw lever 83 is pivotally supported in a bracket 81 on the underside of the machine frame through a pin 82, and is held in engagement at one end with a groove cam 84, the other end of the seesaw lever 83 being held in engagement with the lower end of the core rod 78. The seesaw lever 83 is vertically pivotable through the rotation of the groove cam 84. Therefore, the horizontal bar 79 is vertically displaced in integral relation with the core rod 78; and as the horizontal bar 79 moves downward, the two spatula plates 80, 80 are inserted into bag 35. A pivot lever 85 pivotally supported on the ceiling of the machine frame 18 through a pin 90 is connected through linkage 87 to a lever 86 fixed to the core rod 78, and a follower 88 at the lower end of the pivot lever 85 is held in engagement with a cam provided on a shaft 89 coaxial with the groove cam 84 so that the core rod 78 is movable both ways within an angular range of 60°. Therefore, at the bag opening station 201 in FIG. 1, the horizontal bar 79 used in inserting two spatula plates into bag 35 is rotated integrally with the table 11 until next filling station 202 is reached, and while the table 11 is in standstill condition, the horizontal bar 79 is repeatedly reciprocated to and from the bag opening station 201.

FIG. 5 illustrates the core rod 78 in enlarged form. The core rod 78 is internally hollow such that a stationary rod 91 is disposed in the interior of the core rod, the lower end of the stationary rod 91 being fixed to a block 93 on which is supported the lower end of the core rod 78 through a ball bearing 92. A pin 94 projects outward from opposite ends of the block 93 to provide engagement portions to be engaged by the seesaw bar 83 (FIG. 2). The ball bearing 92 is interposed between the core rod 78 and the block 93. Therefore, when the lever 86 is operated to rotate the core rod 78, the core rod 78 is independently rotatable relative to the block 93, so that the stationary rod 91 supported on the block 93 can be constantly held stationary independently of the rotation of the core rod 78. A support plate 95 extending obliquely downwardly from the top end of the stationary bar over a predetermined transverse length is disposed as shown, and the support plate 95 is engaged at its front end by one end of a linkage 97 through a pin 96, the other end of the linkage 97 being connected through a pin 100 to one end of an auxiliary linkage 99 which is pivotally supported (98) at its other end to the lateral bar 79. Shafts 101, 101 supporting the two spatula plates 80, 80 to the lateral bar 79 are provided respectively with connecting plates 102, 103. The spatula plates are securely fixed to the connecting plates respectively. Therefore, an angle formed by the one spatula plate 80 relative to the connecting plate 102, and an angle formed by the other spatula plate 80 relative to the connecting plate 103 are both invariable. Hence, by holding a pin 105 attached to the connecting plate 102 in engagement with a slit 104 formed in the connecting plate 103 it is possible to move the two spatula plates 80, 80 in cooperation with each other.

The tensile force of a coil spring wrapped about each of the shafts 101, 101 constantly urges the two spatula plates 80, 80 to separate from each other. A contact plate 106 connected to the shaft 101 is adapted to contact the end of the linkage 97 which functions as a stopper. Through this arrangement the biasing force of the coil springs can be restrained. The support plate 95 in FIG. 1 is not movable from its position shown, and as the horizontal bar 79 is rotated clockwise, the linkage 97 connected to the support plate 95 is pulled relative to the rotation of the horizontal bar 79. That is, in FIG. 6, through the rotation 107 of the core rod 78, the horizontal bar 79 is shifted, but the linkage 97 remains unmoved. Thus, the action of the stopper 106 is released in relation to the contact plate 106. Hence, the two spatula plates 80, 80 cause the mouth of the bag 35 to be opened wide under the tensile force of the coil springs on the shafts 101, 101. In the filling station 202 in FIG. 1, the two spatula plates 80, 80 serve as a guide such that the cylinder portion of the hopper 110 is inserted between the plates 80, 80 to enable a fill of goods to be introduced into the bag.

At the filling station 202 in FIG. 1, each bag into which a fill of goods has been introduced is conveyed while being suspended from clamp arms 12, 13 until it reaches the final station or release station 205 via intermediate stations 203, 204 at which a temporary stop is required each time. At the release station 205, as FIG. 7 shows, a second attachment 111 is pivotally supported on machine frame 112 through a pin 113, and a seesaw lever 116 is provided which is pivotable about a central pin 115 in conjunction with the rotation of a cam 114. Respective ends of the seesaw lever 116 and second attachment 111 are interconnected through a cylinder 117. A normal open type three-way valve 120 is interposed midway a line 119 interconnecting the cylinder 117 and a pressure pump 118. Piston rod 121 is constantly in stretched condition under the pressure from the pressure pump 118. Therefore, when clamp arms 12, 13 stop at the release station 205, the second attachment 111 applies pressure to the pin rolls 65 to open the clamps 34 so as to release bag 35. At the station 205, as FIG. 1 shows, a bag delivery device 124 is provided for transfer to chamber 125 of each bag released from clamp arms 12, 13.

Figure 8:
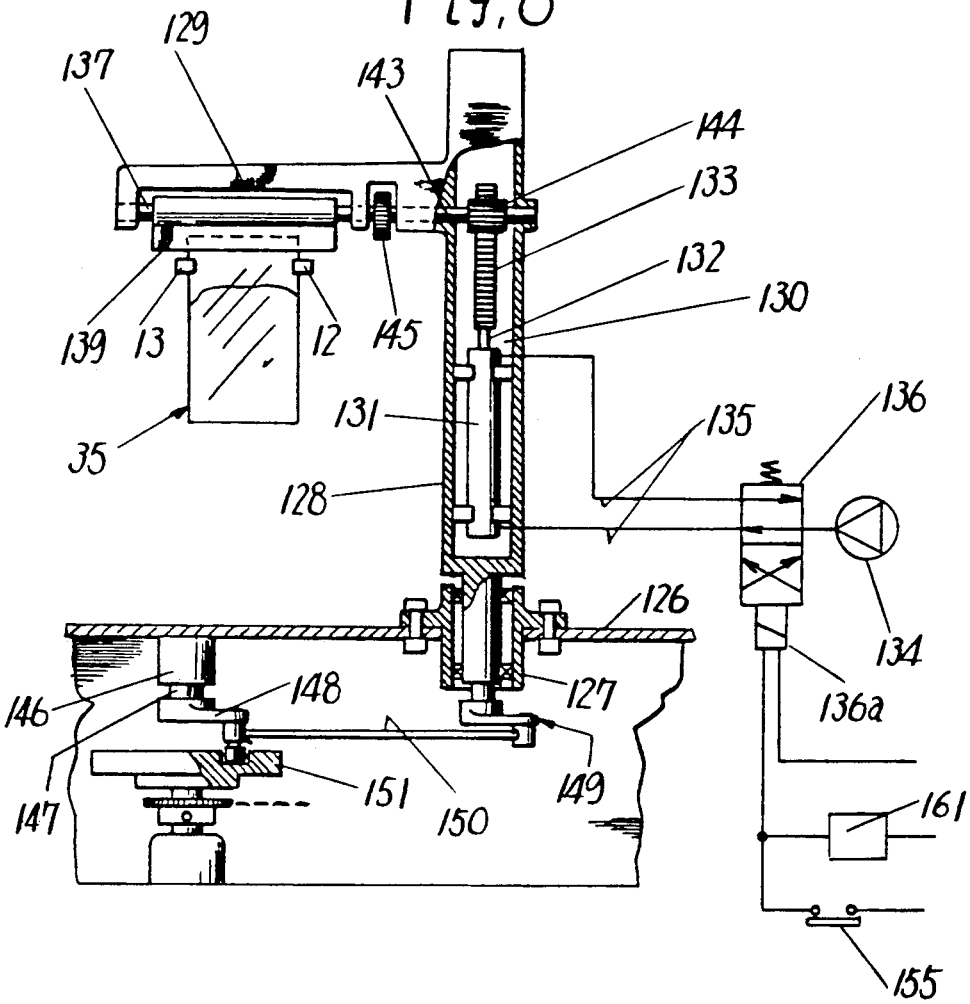
FIG. 8 is a front view in section showing a bag transfer device.
Figure 9:
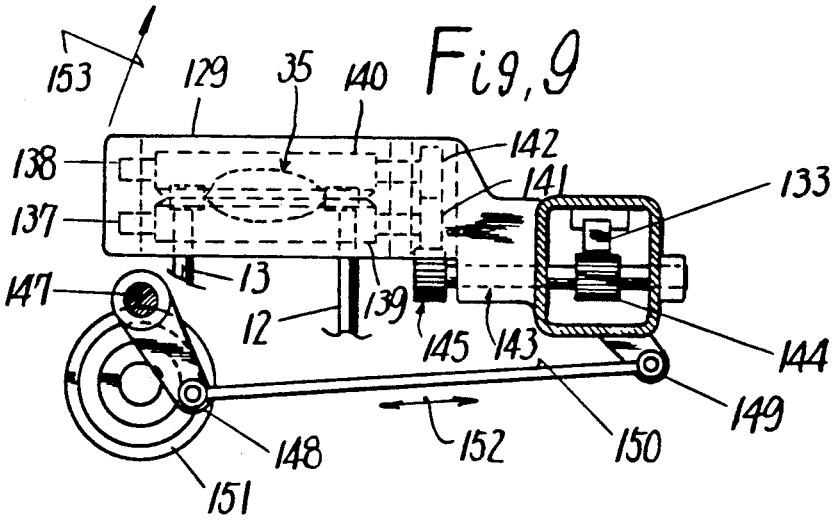
FIG. 9 is a plan view thereof.
Figure 13:
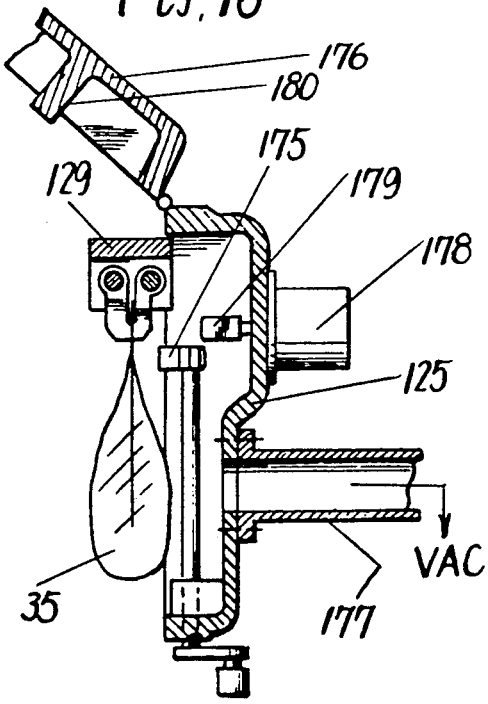
FIG. 13 is a sectional view showing a vacuum chamber.

As FIGS. 8 and 9 show, the bag delivery device includes an L-shaped frame consisting of a pole 128 supported in a bearing 127 fixed to machine frame 126, and a support member 129 projecting laterally from one side of the pole. The pole 128 has a hollow chamber 130 in its upper portion, a rack 133 fixed to the top of a piston rod 132 of an air cylinder 131 securely mounted in the chamber 130, and a two-position, four-port type changeover valve 136 interposed midway a line 135 interconnecting the air cylinder 131 and the pressure pump 134. The support member 129 carries two parallel rotary shafts 137, 138, collar members 139, 140 secured respectively to the rotary shafts 137, 138, and universal gears 141, 142 fixed respectively to the rotary shafts at one end thereof, which gears 141, 142 are in mesh with each other. A pinion 144 and an intermediary gear 145 are provided on an intermediary shaft 143 extending along the support member 129 and free to rotate, with the pinion 144 held in mesh with the rack 133, the intermediary gear 141 being in engagement at one end with the universal gear 141. A switch 155 is interposed in an electric circuit which controls the changeover valve 136. As FIG. 7 shows, the switch 155 turns on and off through the rotation of a cam 156 and, as the switch 155 turns on and off, the rack 133 connected to the air cylinder 131 moves up and down so that the two parallel rotary shafts 137, 138 are rotated in opposite directions through the intermediary shaft 143 to enable the pair of collar members 139, 140 to catch a bag 35 just before the bag 35 is released from the two clamp arms 12, 13. A driving lever 148 supported through a shaft 147 in a bearing 146 formed on the underside of the machine frame is coupled through a linkage 150 with a driven lever 149 fixed to the lower end of the pole 128, the driving lever 148 being held in engagement with the cam 151. The driving lever 148 is pivoted by the cam 151, which motion is transmitted as a reciprocal motion 152 to the driven lever 149 through the linkage 150, whereby the distal end of the support member 129 goes into a reciprocal horizontal movement. Therefore, in FIG. 1, the support member 129 of the bag release device 124 pivots about the pole 128 between the clamp arm 12, 13 and the chamber 125. Each bag 35 suspended from the support member 129 is transferred to a clamp 175 in the chamber 125, as shown in FIG. 13. Thereafter, a cover member 176 hermetically covers the chamber 125 so that air is sucked off the airtight interior of the chamber through a passage 177. During the movement of the chamber 125 around the circular track, an actuator 178 forces a seal bar 179 against a seal bed 180 to heat seal the opening edge of the bag 35.

Nextly, one example of the process of bag recycling to which the present invention is primarily directed will be explained.

As FIG. 2 shows, the main shaft 17 includes a cam 157 having 6 protrusions formed on its periphery. As it rotates integrally with the main shaft, the cam 157 goes in contact with a switch 158 so that a signal issued from the switch is inputted to a shift register 161 through a circuit 159. Thus, on the basis of signals from the switch 158, the shift register 161 constantly detects positions of six sets of clamp arms 12, 13.

In FIG. 1, a switch 160 is disposed in a bag passage zone adjacent the bag filling station 202. Each time a bag 35 conveyed while being suspended from clamp arms touches the switch 160, data issued from the switch 160 is inputted to the shift register 161. More specifically, the switch 160 reacts to a weighty bag or filled bag, but it does not react to an empty bag or unfilled bag. Therefore, one of a series of successive signals to be issued at a predetermined pitch is not issued if one empty bag is included in the corresponding series of bags which have passed the location of the switch 160. In this way, the switch 160 electrically detects a fill of goods contained in each bag, and only when the presence of such a fill is detected, a detection signal is inputted to the shift register 161.

Figure 10:
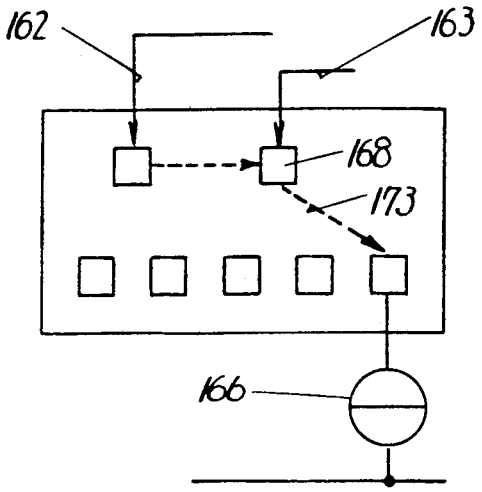
FIGS. 10 to 12 are electric circuit diagram for the apparatus.

Data 162 from the switch 160 (FIG. 10) and shift timing signals 163 from the switch 158 are supplied to the control panel shown in FIG. 10 at predetermined time intervals, and a command signal 173 is issued from a device 168 each time accordingly. Where data 162 is being inputted, command signal 173 has no function to control a relay switch 166. However, if an empty or unfilled bag passes, one corresponding signal from the switch 160 is not issued and a shift timing signal 163 only from the switch 158 is inputted. Then, the timing of the arrival of the particular empty bag at the final stop position 205 is counted, and a command signal 173 is issued upon the timed arrival of the empty bag, to close the relay switch 166. That is, in FIG. 1, the release station 205 corresponds to the third station counting from the filling station 202; and therefore the relay switch 166 is closed at same timing as arrival at the release station 205 of the unfilled bag 35 suspended from the clamp arms 12, 13.

Figure 12:
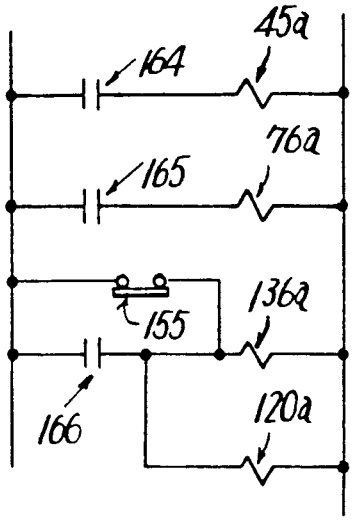

Accordingly, in FIG. 12, coils 120*a*, 136*a* are excited, and in FIGS. 7 and 8, changeover valves 120, 136 are temporarily switched. The word "temporarily" used here means a period of time in which the particular empty bag suspended from clamp arms 12, 13 is in stop condition. In FIG. 7, the changeover valve 120 is switched, the pressure in the cylinder 117 is removed and accordingly the attachment 111 ceases to press the pin rolls 65, with the result that clamps 34 hold the bag 35 in its present position without being opened. When the changeover valve 136 in FIG. 8 is switched, the pair of collar members 139, 140 are rendered immovable and are prevented from performing its function to transfer the bag to the chamber 125. In effect, the clamp arms 12, 13 pass through the release station 205 while holding the bag as such.

It is noted that the seal means consisting of a seal bar 179 and a seal bed 180 may be provided at a fourth stop position 203 or at a fifth stop position 204, instead of being provided in the chamber 125 at the release station 205; provided, however, that the effect of closing the relay switch 166 should advantageously extend to the seal means.

Figure 11:
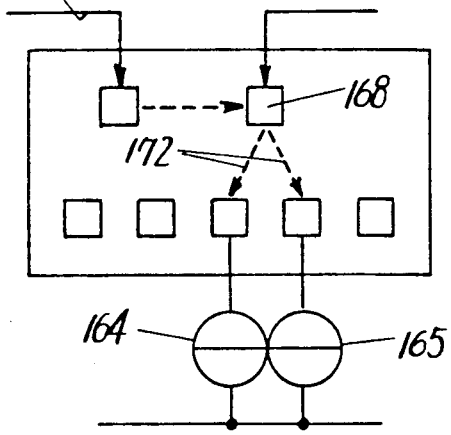

Similarly, as FIG. 11 shows, a command signal 172 has also been issued from the device 168. In this case, the bag supply station 200 corresponds to a fourth station counting from the filling station 202. Therefore, simultaneously upon the arrival of the empty bag at the bag supply station 200, the two relay switches 164, 165 are closed in response to the command signal 172. Accordingly, in FIG. 12, coils 45*a*, 76*a* are excited, and in FIGS. 3 and 4, the changeover valves 45, 76 are temporarily switched. In FIG. 3, when the changeover valve 45 is switched, the vacuum cup 42 does not perform its sucking function and does not fetch any from the stack of bags. In FIG. 4, when the changeover valve 76 is switched, the pressure in the cylinder 69 is removed, and the attachment 66 does not apply any pressing force against the roll pin 65. Therefore, clamps 34 maintains their empty bag 35 holding condition. In effect, the empty bag passes through as it is suspended from the clamp arms 12, 13, and the empty bag is recycled.

Bag recycling is carried out under the condition that, as FIG. 6 shows, the two spatula plates 80, 80 are holding the mouth of the bag 35 open wide and a contact finger 171 is not contacting the second switch 170 on the horizontal bar 79. Assume that no bag is being supplied to clamp 34, or that the bag supplied is inversely supported by clamp 34. In such case, no resistance of bag 35 is applied to the spatula plate 80, and therefore the contact finger 171 acts on the switch 170 and no bag recycling is performed. In such case, at the filling station 202, as in FIG. 1, bag filling is not performed and, therefore, the first switch 160 is not actuated. Accordingly, clamp arms 12, 13 pass through the release station 205 while holding themselves in closed condition. When data 174 from the second switch 170 (FIG. 11) is inputted to the device 168, the relay coils 164, 165 are held in their usual opened condition, and accordingly clamp 34 is opened at the bag supply station (if a bag is invertedly suspended, the bag is dropped down), a new bag being then supplied to the clamp 34.

As FIG. 4 shows, the clamp 34 at clamp arm 12 is biased into normal closure condition under the biasing force of the tension spring 63. In another embodiment, hydraulic pressure may be applied to the interior of the clamp arm 121, and this hydraulic pressure is utilized as a force generating source in order to close the clamp 34. In this case, it is possible to open the clamp 34 by changing the direction of flow of the hydraulic pressure.

Figure 14:
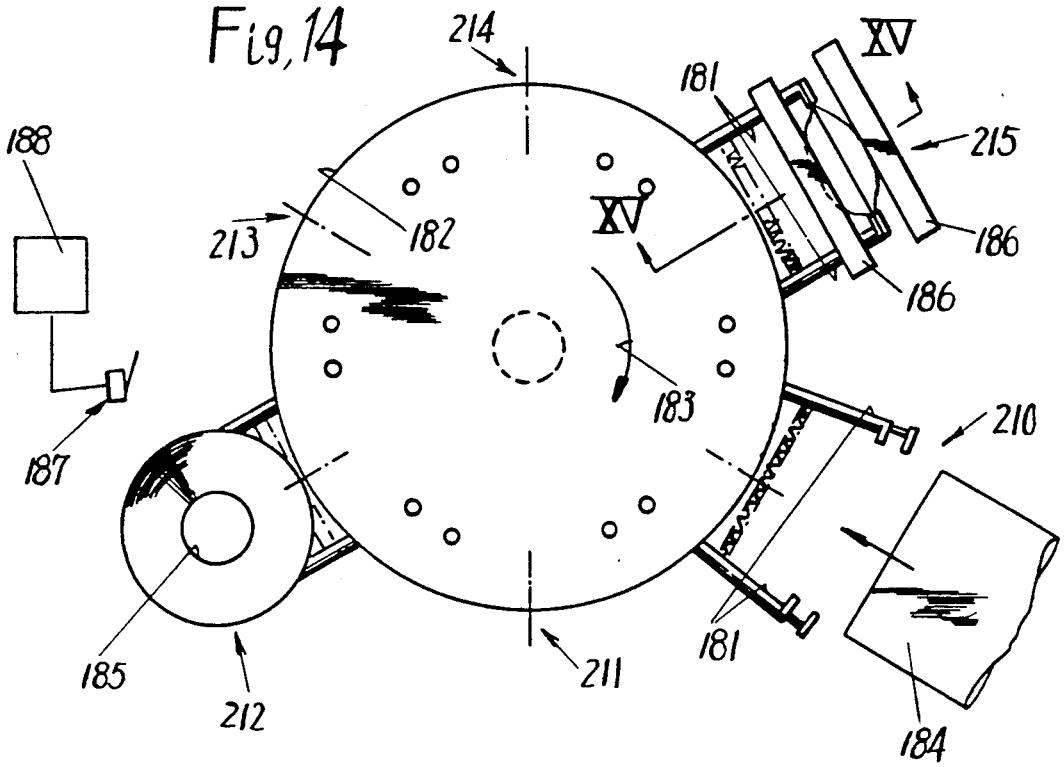
FIG. 14 is a plan view showing another embodiment of the invention.
Figure 15:
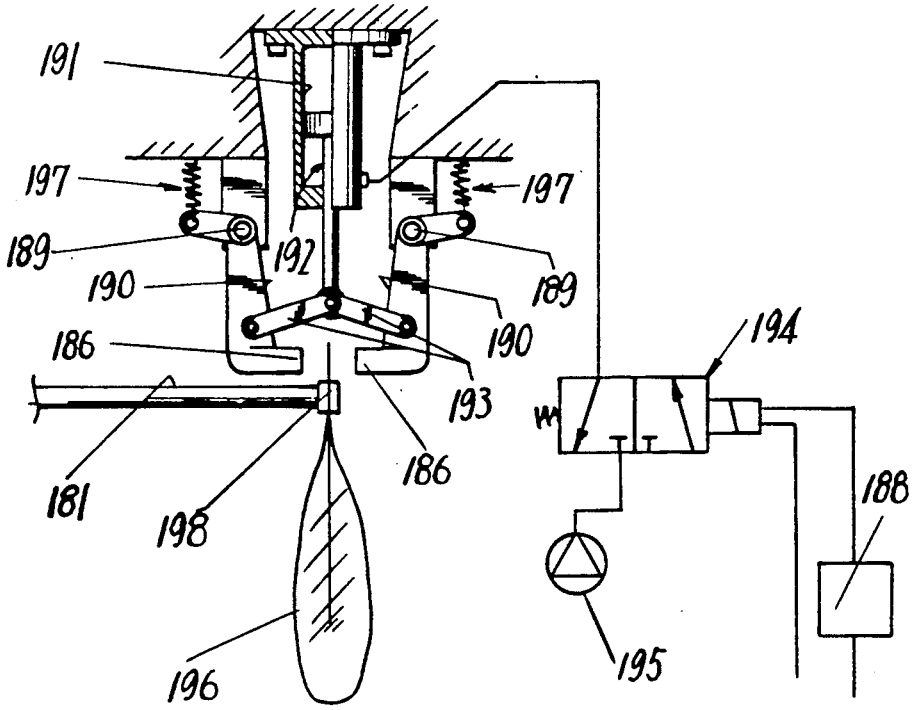
FIG. 15 is a section taken along line XV—XV in FIG. 14 in the direction of the arrow.

FIG. 14 illustrates another embodiment of the invention, wherein the apparatus comprises a table 182 having six sets of radially extending clamp arms 181 and rotatable in the direction of arrow 183, with six stop positions defined therein comprising a first stop position 210 for supplying empty bags 184 to clamp arms 181, a second stop position 211 such that the mouth of each bag carried by clamp arms is opened adjacent the second stop position 211, a third stop position 212 for filling each bag with a fill of goods through a hopper 185, a fourth stop position 213 for introducing an additive into each bag, a fifth stop position 214 at which the mouth of each bag is made taut, and a sixth stop position 215 for heat-sealing the mouth of each filled bag by means of a pair of seal bars 186, 186 and for removing a bag from each set of clamp arms 181. In this embodiment, the apparatus has no such vacuum packaging chamber as shown in FIG. 1, and bag sealing is carried out at the final stop position 215. In the embodiment, in case that a bag is not filled with goods at the third stop position 212, a switch 187 for detecting the presence or non-presence of a fill of goods in each bag sends a signal via a shift register 188 to the sixth stop position 215 and first stop position 210. As FIG. 15 shows, seal bars 186, 186 are disposed at the lower ends of a pair of arms 190, 190 pivotally supported at their upper ends about a pin 189 on the machine frame, which arms 190, 190 are connected through a linkage 193 to a piston rod 192 of a cylinder 191. Further, a pump 195 is connected to the cylinder 191 through a changeover valve 194. When each bag 196 carried by clamp arms 181 reaches a space between the pair of seal bars 186, 186, the cylinder operates to move the pair of seal bars 186, 186 against the tensile force of a spring 197 into abutment with each other for heat sealing the mouth of the bag. If the bag 196 is not filled with goods, and if the shift register 188 has previously received a signal indicative of that fact, the changeover valve 194 does not operate even if the empty bag reaches the space between the seal bars 186, 186, sealing action with respect to the bag can be effectively avoided. In this case, clamp 198 is not opened at the sixth stop position 215 and first stop position 210, and bag supply is temporarily suspended to enable bag recycling to be carried out meanwhile. For this purpose, same devices as shown in FIGS. 3, 4 and 7 are employed.

What is claimed is:

1. A packaging apparatus including a multiplicity of clamps biased constantly in closed condition by force generating means and arranged in angularly equispaced relation on an endless track, the clamps being adapted to be intermittently advanced along the endless track at a pitch equal to the distance between each two adjacent clamps, bag supply means located at a first stop position at which the clamps are initially caused to stop in the course of their movement on the endless track, for supplying bags to temporarily opened clamps, it being so arranged that the clamps are caused to stop at a second stop position to enable an article to be filled into each of the bags suspended from the clamps and are again caused to stop at a final stop position at which the bags are released from the clamps, comprising:

a shift register for generating shift timing signals of same timing as intermittent movement of the clamps on the endless track and for detecting said final stop position and said first stop position on the endless track;

an input switch for electrically detecting the condition of filling effected with respect to each of the bags suspended from the clamps and for inputting to said shift register a detection signal with respect to said condition; and means responsive to command signals from said shift register when any unfilled bag detected by said switch has reached said final position on the endless track and, in turn, when the unfilled bag has reached said first stop position, for maintaining the action of said force generating means on the clamps at the two positions thereby to cause the clamps to be kept in their closed condition.

2. A packaging apparatus as set forth in claim 1, wherein there are provided means responsive to a command signal from said shift register when the unfilled bag detected by said switch has reached said first stop position, for keeping said bag supply means in non-operative condition.

3. A packaging apparatus as set forth in claim 1, wherein between said first stop position and said stop position for bag filling there is provided another stop position with means for mouth bag opening, and wherein at said another stop position there is provided a bag detecting switch which generates a signal for opening any particular clamp when the clamp reaches said first stop position, if the bag on the clamp has applied no resistance to the bag mouth opening means.

4. A packaging apparatus as set forth in claim 1, wherein between said second stop position for bag filling and said final stop position there is provided seal means for bag mouth sealing, and wherein there are provided means responsive to a command signal from said shift register for keeping said seal means in non-operative condition, when the unfilled bag detected by said switch has reached said seal means.

5. A packaging apparatus as set forth in claim 4, wherein there are provided means responsive to a command signal from said shift register for keeping said bag supply means in non-operative condition, when the unfilled bag detected by said switch has again reached said first stop position for recycling.

6. A packaging apparatus as set forth in claim 1, wherein at said final stop position there are provided vacuum packaging means for sucking air internally of each filled bag and for sealing the mouth of the bag, and means for delivering filled bags to said vacuum packaging means, and wherein there are provided means responsive to a command signal from said shift register for keeping said delivery means in non-operative condition, when the unfilled bag detected by said switch has reached said final stop position.

7. A packaging apparatus as set forth in claim 6, wherein there are provided means responsive to a command signal from said shift register for keeping said bag supply means in non-operative condition, when the unfilled bag detected by said switch has reached said first stop position for recycling.

* * * * *